United States Patent [19]

Schibbye et al.

[11] Patent Number: 4,842,501

[45] Date of Patent: Jun. 27, 1989

[54] DEVICE FOR CONTROLLING THE INTERNAL COMPRESSION IN A SCREW COMPRESSOR

[75] Inventors: Lauritz B. Schibbye, Saltsjö-Duvnäs; Rolf A. Englund, Spanga, both of Sweden

[73] Assignee: Sullair Technology AB, Sweden

[21] Appl. No.: 707,545

[22] Filed: Mar. 4, 1985

Related U.S. Application Data

[63] Continuation-in-part of Ser. No. 489,788, Apr. 29, 1983, abandoned.

[30] Foreign Application Priority Data

Apr. 30, 1982 [SE] Sweden ..... 8202734

[51] Int. Cl.[4] ..... F04C 29/08

[52] U.S. Cl. ..... 418/201

[58] Field of Search ..... 418/201, 203, 159; 417/307, 310, 440; 251/63, 504

[56] References Cited

U.S. PATENT DOCUMENTS

| | | | |
|---|---|---|---|
| 3,936,239 | 2/1976 | Shaw | 418/201 |
| 4,042,310 | 8/1977 | Schibbye | 418/201 |
| 4,388,048 | 6/1983 | Shaw | 418/201 |

FOREIGN PATENT DOCUMENTS

| | | | |
|---|---|---|---|
| 2076896 | 12/1981 | United Kingdom | 418/201 |

*Primary Examiner*—Leonard E. Smith

*Attorney, Agent, or Firm*—Wood, Dalton, Phillips, Mason & Rowe

[57] ABSTRACT

This invention relates to a device for controlling the internal compression in a screw compressor and to a screw compressor equipped with a device for internal compression control. In the compressor housing (10) an axially movable sliding vlave (17) for controlling the internal compression is located in paralllel with the rotors on the discharge side thereof. In the position yielding the highest internal compression, the sliding valve extends over the major part of the length of the rotors and outwardly over the inlet end plane (18) of the compressor.

5 Claims, 4 Drawing Sheets

DEVICE FOR CONTROLLING THE INTERNAL COMPRESSION IN A SCREW COMPRESSOR

This application is a continuation-in-part of application Ser. No. 489,788, filed Apr. 29, 1983, now abandoned.

This invention relates to a device for controlling the internal compression in a screw compressor and to a screw compressor comprising such an internal compression control device.

It is previously known, for example through patent application SE 8103032-2, to unload the compressor by means of valves arranged in the rotor barrels radially in relation to the compressor rotors in order thereby to stepwise control the capacity of the compressor. As the discharge port of the compressor is not affected, this implies that the internal compression in the compressor decreases when the capacity of the compressor decreases.

It is desired, however, the internal compression is not affected appreciably in connection with capacity control, and it is preferably desired to be able to control the internal compression even when the compressor operates at full capacity.

The present invention, therefore, has the object to bring about a device for controlling the internal compression in a screw compressor, so that the internal compression can be maintained when the compressor capacity is reduced, or so that the internal compression can be controlled even when the capacity of the compressor is not changed.

This object is achieved by the device according to the present invention, at which an axially movable sliding valve is located in the compressor housing in parallel with the rotors on their discharge side for controlling the internal compression.

US-PS 3 314 507 anticipates a sliding valve for compressor capacity control where the size of the discharge port is changed upon movement of the sliding valve for capacity control, whereby the internal compression of the compressor is maintained substantially constant. In contrast to this known sliding valve, the function of the sliding valve according to the present invention is only to control the internal compression of the compressor. It is possible by the sliding valve according to the invention to control the internal compression of the compressor also when the compressor operates at full load. The conventional sliding valve does not offer this possibility. Moreover, the valve according to the present invention has a simpler structural design, and as its control system is less complicated the valve is much less expensive to manufacture.

Figure 1:
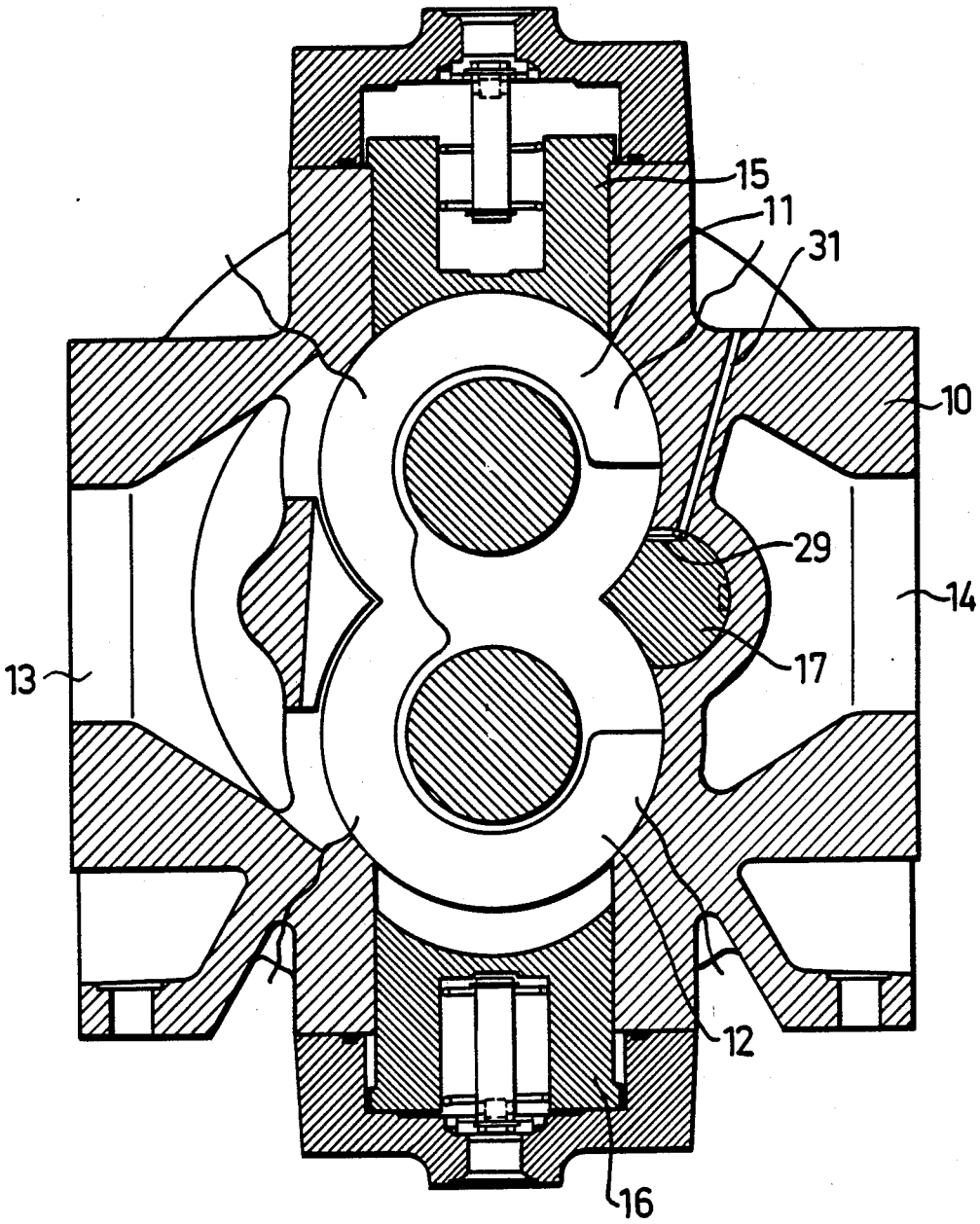

The invention is described in greater detail with reference to the embodiment shown in the accompanying drawings, in which FIG. 1 is a cross-section through a screw compressor comprising sliding valve according to the invention.

Figure 2:
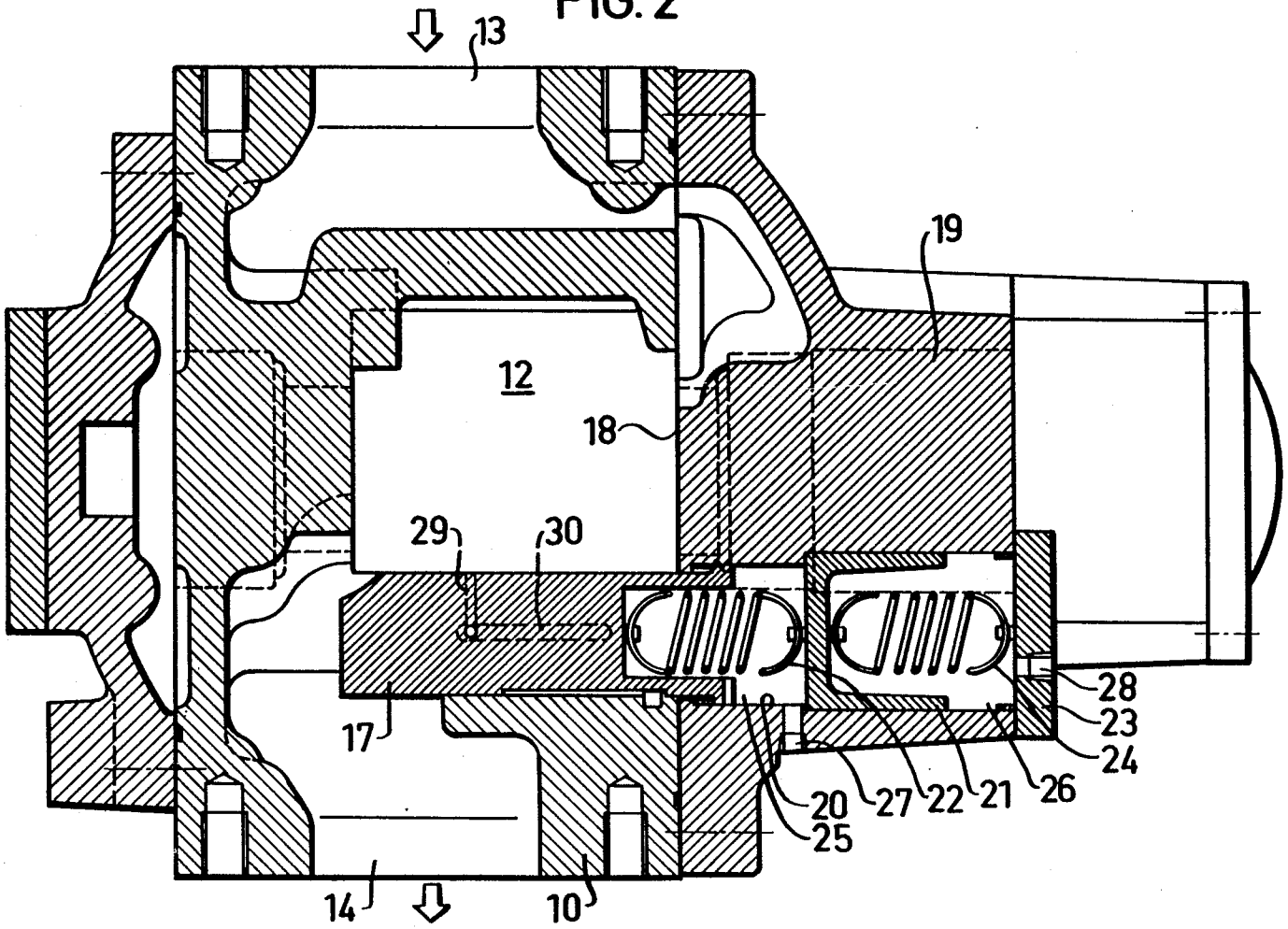
Figure 3:
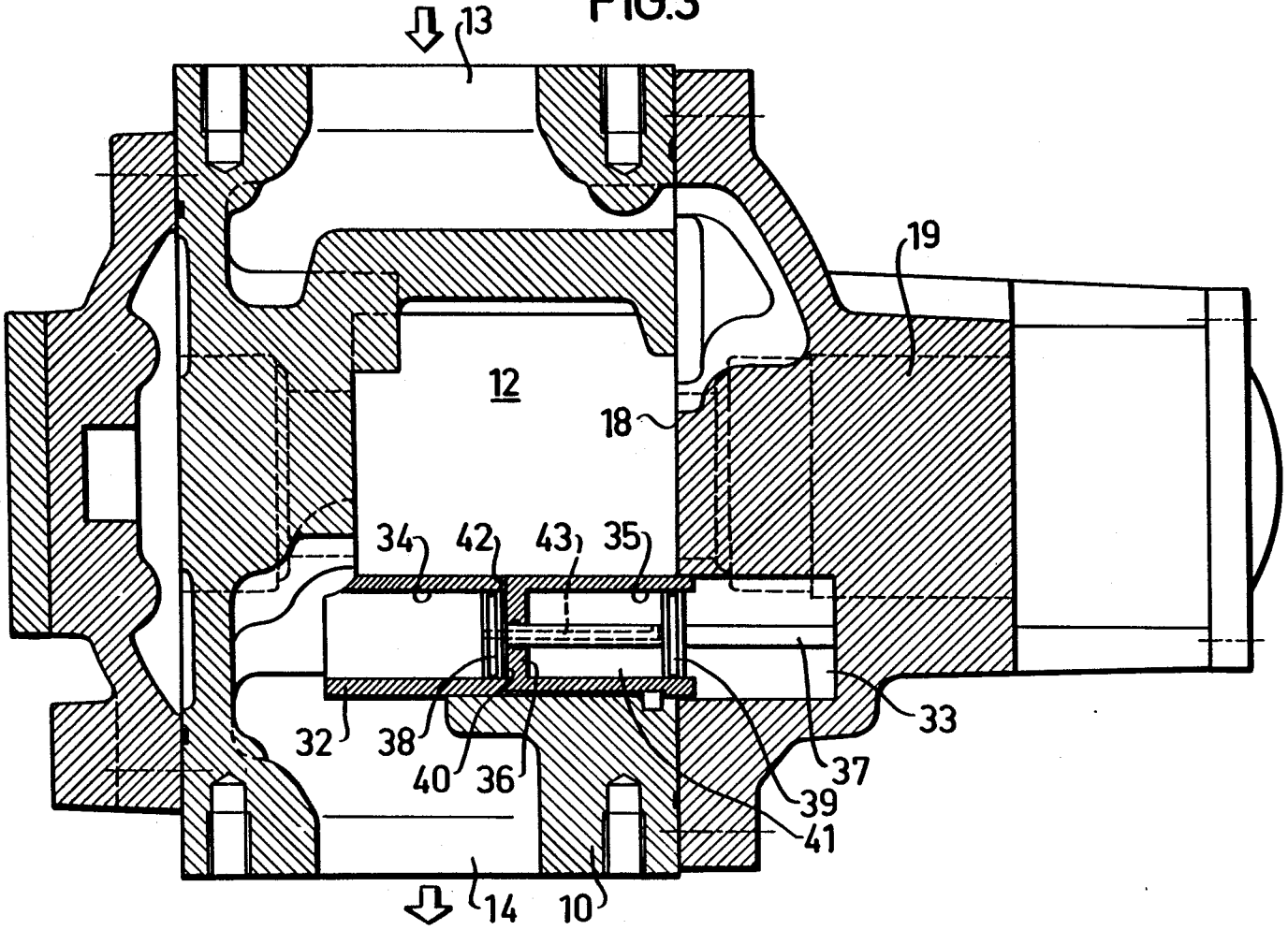
Figure 4:
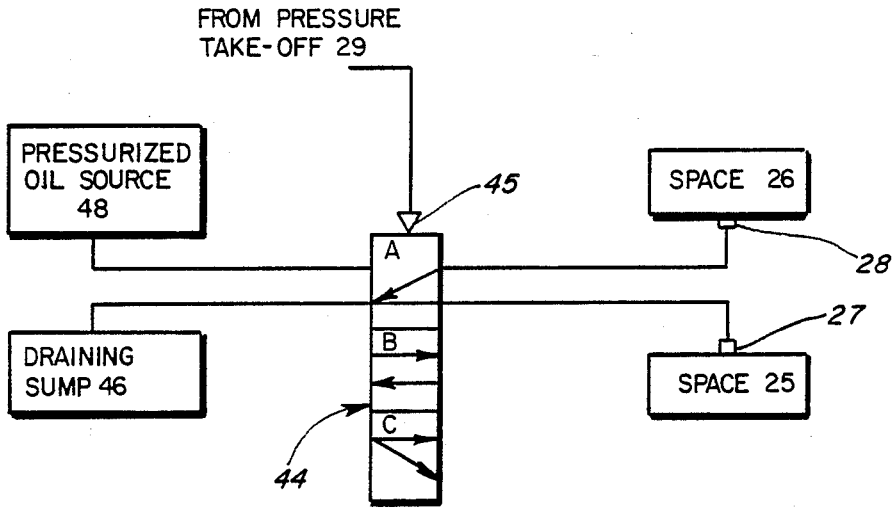
Figure 5:
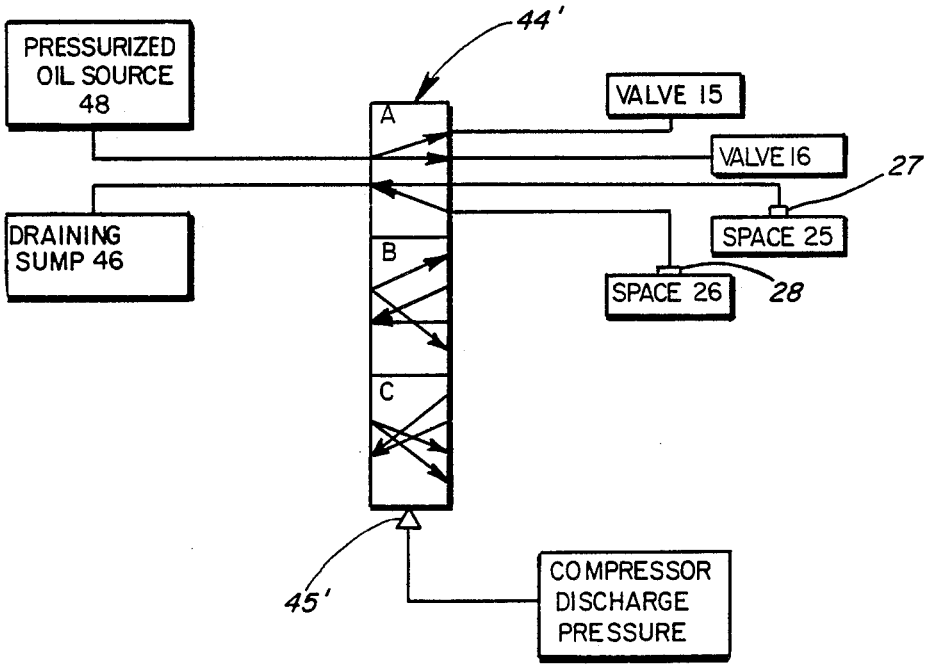

FIG. 2 is a longitudinal section through the screw compressor shown in FIG. 1, FIG. 3 is a corresponding longitudinal section through a screw compressor, the sliding valve of which has a different structural design, FIG. 4 is a schematic view of a hydraulic structure for controlling the compressor according to the invention, and FIG. 5 is a schematic of an alternative structure for controlling the compressor.

FIG. 1 is a cross-section through a screw compressor with a compressor housing 10, in which two rotatable rotors 11,12 meshing with each other are located. The inlet 13 of the compressor is located to the left in FIG. 1, and the discharge opening 14 to the right. Upwardly and downwardly unloading valves 15,16 are arranged radially in relation to the rotors 11,12 for unloading the compressor for controlling its capacity. The unloading valves 15,16 may be arranged as in our U.S. Pat. No. 4,453,900 (the contents of which are hereby incorporated by reference) to achieve effective unloading. For being able to control the internal compression of the compressor, an axially movable sliding valve 17 is located in parallel with the rotors at the discharge opening 14.

It appears more clearly from FIG. 2 how this sliding valve is arranged. It is movable in axial direction, and FIG. 2 shows the valve in its left-hand position where it extends over the entire length of the rotors and thereby prevents the compressed gas from flowing out radially. The gas compressed in the compressor then flows out substantially in axial direction through the axial portion of the discharge port. The sliding valve 17, however, can be moved to the right in FIG. 2, in which case also a radial portion of the discharge port from the rotors will be opened for the gas flowing out. Hereby, thus, the size of the discharge port, and therewith also the internal compression of the compressor, can be controlled.

The sliding valve 17 extends outward over the inlet end plane 18 of the compressor. In the inlet housing 19 of the compressor, a bore 20 is located, in which the sliding valve 17 can slide, and in which a movable piston 21 is provided. Between the sliding valve 17 and piston 21, a first spring 22 is located, and between the piston 21 and a mounting plate 23 located outside the inlet housing 19 a second spring 24 is provided. In the bore 20, on both sides of the piston 21, two pressure spaces 25,26 are defined, in which the springs 22 and 24 are located respectively. To said two pressure spaces 25,26 connections 27 and 28 respectively, are attached through which pressure oil is supplied for moving the sliding valve 17 to its left-hand position. By draining the pressure oil from the pressure space 25, the spring 22 draws the sliding valve 17 to the right, whereby a part of the radial portion of the discharge port is opened. By draining the pressure oil also from the pressure space 26, the spring 24 moves the sliding valve 17 further to the right, whereby a further portion of the radial discharge port is opened. The sliding valve, thus, is adjustable in two steps by draining the pressure oil from one or both of the two pressure spaces 25,26. In the sliding valve 17 a pressure take-off 29 is provided for rendering it possible via a slit 30 in the valve to transfer the pressure at the pressure take-off 29 in the compression space to a bore 31 through the compressor housing 10, so that the pressure can be utilized for controlling by a regulator valve 44 (arranged for instance as shown in FIG. 4), the axial position of the valve 17 by means of alternatively oil pressurizing or oil draining the spaces 25 and 26 via the connections 27 and 28 by relating the pressure to certain selected pressure values. The pressure take-off 29 is located at a distance from the left-hand end of the sliding valve 17, which distance corresponds to or slightly exceeds one thread pitch of the rotors.

In FIG. 4 the pressure take-off 29 is connected to a pilot 45 used for controlling the regulator valve 44. In the position shown in FIG. 4 when the pressure in the take-off 29 is equal to a first selected value in relation to the discharge pressure, panel A of the regulator valve 44 operates to connect the spaces 25 and 26 to draining sump 46 whereby the valve 17 is positioned at its end position to the right in FIG. 2.

When the internal compressor pressure as reflected at the take-off 29 decreases to a second selected value (due to, for instance, a lowering of the compressor capacity), the pilot 45 in response will shift the regulator valve 44 so as to make panel B operative. Panel B supplies oil pressure from the pressurized oil source 48 to the pressure space 26, thereby means of oil pressure moving the valve 17 to its left-hand end position in the space 26. The pressurized oil source 48 is preferably the compressor oil separator, through it could also be a suitable oil pump.

Should the internal compressor pressure in take-off 29 decrease to a third selected value, panel C of the regulator valve 40 would then become operative to supply oil pressure not only to space 26 but also to space 25, thereby moving the valve 17 by means of the oil pressure to its left-hand end position in the space 25. In this manner a stepwise movement of the valve 17 is obtained resulting in a control of the internal compression in the compressor to certain selected values in relation to the pressure at the take-off 29.

Another arrangement for the combined controlling of the compressor valves for capacity and built in compression is shown schematically in FIG. 5. By this arrangement, variations in the discharge pressure (caused by, for instance, different demands of gas delivered from the compressor) are utilized to control the compressor valves by connecting the discharge pressure to a pilot 42' used for controlling a regulator valve 44'.

In the position shown in FIG. 5, when the discharge pressure is equal to a first selected value, panel A of the regulator valve 44' operates to connect the spaces 25 and 26 to the oil draining sump 46 whereby the valve 17 by means of the springs 22 and 24 is moved to its right-hand end position. Panel A of the valve 40' simultaneously operates to connect pressurized oil to the capacity controlling valves 15 and 16 to move these valves to the closed end position (i.e. the position of valve 15 in FIG. 1), meaning the compressor is running at full capacity load.

When the discharge pressure due to decreasing demand for gas from the compressor increases to a second selected value, the pilot 45, in FIG. 5 will in response shift the regulator value 44, so as to make panel B operative thereby draining the oil pressure from valve 16 to the draining sump 46. Value 16 will consequently, by means of the spring acting on the valve 16, move to its fully open position resulting in a decrease in the compressor capacity. Simultaneously, panel B causes pressurized oil to be supplied to space 26 whereby the valve 17 moves to the left in FIG. 2 to a position corresponding to the left-hand end position of the piston 21. As a result, a compensation for the decreased internal gas compression in the compressor is obtained.

When the discharge pressure due to still decreasing demand for gas from the compressor is further increased to a third selected value, the pilot 45' in FIG. 5 in response will shift the regulator valve 44' so as to make panel C operative. Panel C drains the oil pressure not only from valve 16 but also from valve 15 to the draining sump 46 whereby both these two valves 15,16 will move to their fully open position, resulting in a further decrease of the compressor capacity. Panel C simultanously supplies pressurized oil not only to space 26 but also to space 25 whereby the valve 17 moves another step to the left corresponding to the left-hand end position of the valve 17 in the space 25, meaning that a second compensation of the further decrease of the internal gas compression in the compressor is obtained.

In FIG. 3 another accomplishment 32 of a sliding valve is shown, which like the sliding valve 17 in FIG. 2 extends in parallel with the rotors and outward over the inlet end plane 18 of the compressor. The sliding valve 32 is movable from its left-hand position shown in FIG. 3 to the right in a cavity 33 in the inlet housing 19. The sliding valve 32 includes two internal cylindric bores 34 and 35 separated by an inner wall 36 located substantially centrally of the valve. A piston rod 37 extending through the wall 36 is attached in the inlet housing 19 in said cavity 33. On both sides of the wall 36, a piston 38 and 39 respectively, are provided on said piston rod 37. Said pistons are sealed against the cylindric bores 34,35 by sealing rings, and the wall 36 is sealed against the piston rod 37 by a sealing ring. Hereby, two pressure spaces 40 and 41 respectively, are formed between the wall 36 and the two pistons 38,39, to which pressure spaces a pressure medium can be supplied for controlling the axial position of the sliding valve 32. As pressure medium the gas prevailing in the compressor can be used, and for obtaining automatic control of the sliding valve 32 a first connection 42 can be provided between the compression spaces of the rotors and the pressure space 40, and a second connection 43 can be provided through the piston 38 and piston rod 37 for connecting the discharge channel of the compressor to the pressure space 41. Said first connection 42 corresponds to the pressure take-off 29 of the sliding valve 17 in FIG. 2 and is located at the same distance from the left-hand end of the sliding valve 32 as the pressure take-off 29 is located from the left-hand end of the sliding valve 17. The function of the sliding valve 32 also in the same as that of the sliding valve 17 in FIG. 2, but instead of being adjustable in steps, the sliding valve 32 can be adjusted continuously.

What we claim is:

1. A fluid injected screw compressor having a compressor housing with a suction side communicating with a compression space including two intermeshing rotors, said compression space having an inlet part including an inlet end plane adjacent the suction side and a compression part, the improvement comprising:

an axially movable sliding valve for controlling the internal compression in the compressor arranged in parallel with the rotors at the compression part of the compression space, which sliding valve in the position yielding the highest internal compression extends over the major part of the length of the rotors and outwardly over said inlet end plane and is axially adjustable in response to the outlet pressure from the compressor, at least one unloading valve on each side of the compressor housing movable radially to the rotors for controlling the compressor capacity, each of said unloading valves being substantially positioned in the plane going through the centers of both rotors and connected to the compression space so that when opened a part of the gas will be discharged from the compression space to the suction side of the compressor, and pressure spaces and tension springs arranged in series and acting upon the sliding valve to make the sliding valve adjustable in steps.

2. A compressor as defined in claim 1, wherein the sliding valve is controlled in a first step through influence by a first tension spring and the pressure in a first pressure space in relation to the stepwise capacity reduction obtained by opening the first unloading valve.

3. A compressor as defined in claim 2, wherein the sliding valve is controlled in a second step through influence by a second tension spring and the pressure in a second pressure space in relation to the stepwise capacity reduction obtained by opening the other unloading valve.

4. A fluid injected screw compressor having a compressor housing with a suction side communicating with a compression space including two intermeshing rotors, said compression space having an inlet part including an inlet end plane adjacent the suction side and a compression part, the improvement comprising:

an axially movable sliding valve for controlling the internal compression in the compressor arranged in parallel with the rotors at the compression part of the compression space, which sliding valve in the position yielding the highest internal compression extends over the major part of the length of the rotors and outwardly over said inlet end plane and is axially adjustable in response to the outlet pressure from the compressor, and at least one unloading valve on each side of the compressor housing movable radially to the rotors for controlling the compressor capacity, each of said unloading valves being substantially positioned in the plane going through the centers of both rotors and connected to the compression space so that when opened a part of the gas will be discharged from the compression space to the suction side of the compressor, wherein the sliding valve is continuously adjustable and has stationary pistons located in two bores in the slide.

5. A compressor as defined in claim 4, further comprising an inner wall between the pistons and separating the bores to define an outer pressure space and an inner pressure space in the bores, wherein the pressure from a rotor thread space located substantially one thread pitch from the discharge of the compression spaced is supplied via a first connection to the outer pressure space, and the discharge pressure of the compressor is supplied via a second connection to the inner pressure space for automatic adjustment of the axial position of the sliding valve.

* * * * *